US008850846B2

(12) United States Patent
Sillince et al.

(10) Patent No.: US 8,850,846 B2
(45) Date of Patent: Oct. 7, 2014

(54) KEG APPARATUS FOR SELF COOLING AND SELF DISPENSING LIQUIDS

(75) Inventors: Mark Sillince, West Sussex (GB); David Cull, Bankok (TH)

(73) Assignee: Joseph Company International, Inc., Irvine, CA (US)

( * ) Notice: Subject to any disclaimer, the term of this patent is extended or adjusted under 35 U.S.C. 154(b) by 218 days.

(21) Appl. No.: 13/698,986

(22) PCT Filed: May 18, 2011

(86) PCT No.: PCT/US2011/036933

§ 371 (c)(1),
(2), (4) Date: Feb. 14, 2013

(87) PCT Pub. No.: WO2011/146572

PCT Pub. Date: Nov. 24, 2011

(65) Prior Publication Data

US 2013/0133340 A1 May 30, 2013

Related U.S. Application Data

(60) Provisional application No. 61/346,359, filed on May 19, 2010.

(51) Int. Cl.

| | |
|---|---|
| ***F25D 3/08*** | (2006.01) |
| ***F25B 17/08*** | (2006.01) |
| ***F25B 15/00*** | (2006.01) |
| ***B67D 1/08*** | (2006.01) |
| ***F25D 7/00*** | (2006.01) |

(52) U.S. Cl.

CPC ..... *B67D 1/0857* (2013.01); *F25D 2331/802* (2013.01); *F25D 7/00* (2013.01); *B67D 1/0801* (2013.01)

USPC ..... 62/480; 62/371; 62/457.3; 62/457.4; 62/487; 62/488

(58) Field of Classification Search

CPC ..... F25D 3/08; F25D 5/00; F25D 5/02; F25D 7/00; F25D 31/006; F25D 31/007; B67D 1/0857

USPC ..... 62/371, 457.3, 457.4, 480, 487, 488

See application file for complete search history.

(56) References Cited

U.S. PATENT DOCUMENTS

| | | | | |
|---|---|---|---|---|
| 2,063,877 | A * | 12/1936 | Kellogg | 62/56 |
| 4,887,651 | A | 12/1989 | Santiago | |
| 4,925,470 | A | 5/1990 | Chou | |

(Continued)

OTHER PUBLICATIONS

International Search Report, PCT/US2011/036933, mailed Aug. 25, 2011.

*Primary Examiner* — Mohammad M Ali
*Assistant Examiner* — Erik Mendoza-Wilkenfe
(74) *Attorney, Agent, or Firm* — Novak Druce Connolly Bove + Quigg LLP

(57) ABSTRACT

A self-cooling and self dispensing beverage container in the form of a keg which includes a heat exchange unit having a plurality of segments of compressed carbon disposed therein. A valve is secured to a tube attached to the REU housing for carbon dioxide to adsorbed and then desorbed by the carbon for cooling the beverage. A dispense gas canister is disposed within the container to automatically release carbon dioxide to maintain a pressure head within the container sufficient to assure dispensing of the beverage.

11 Claims, 8 Drawing Sheets

(56) References Cited

U.S. PATENT DOCUMENTS

| | | | | |
|---|---|---|---|---|
| 4,993,237 | A | 2/1991 | Bond et al. | |
| 5,331,817 | A * | 7/1994 | Anthony | 62/5 |
| 5,606,866 | A * | 3/1997 | Anthony et al. | 62/294 |
| 5,661,986 | A * | 9/1997 | Labranque | 62/480 |
| 6,125,649 | A * | 10/2000 | Sillince | 62/480 |
| 6,167,718 | B1 | 1/2001 | Halimi et al. | |
| 6,581,401 | B1 | 6/2003 | Anthony | |
| 6,829,902 | B1 | 12/2004 | Claydon | |

* cited by examiner

KEG APPARATUS FOR SELF COOLING AND SELF DISPENSING LIQUIDS

FIELD OF THE INVENTION

The present invention relates generally to a keg like apparatus for dispensing beverages of all types and more particularly to a keg like apparatus for self cooling such beverages and for automatically maintaining pressure within the keg like apparatus for dispensing the cooled beverage.

BACKGROUND OF THE INVENTION

Many beverages are preferably served in a chilled state. There are many prior art systems designed to chill such beverages to a desired temperature. One example of such systems is a glycol cooling system. In this type of system a cooled glycol circulation loop is placed in heat transfer relation with a transport line carrying the beverage or with a reservoir for the beverage. Heat is transferred from the warmer beverage to the glycol cooling loop. The warmed glycol is then cooled by circulating the glycol through a heat exchanger which is part of a separate refrigerant loop. The refrigerant loop typically uses a standard refrigerant such as Freon that is continuously recycled in the refrigerant loop. Heat is transferred within the heat exchanger from the warmed glycol to the refrigerant. Thus in these systems the cooling of the beverage is achieved by indirect cooling, but there is a requirement for use in the refrigeration loop.

Another example of a prior art system requires that the beverage be initially cooled by placing the container, such as a keg, housing the beverage within a refrigeration unit and then moving the cooled container to the area where the beverage is to be dispensed. Obviously this requires the maintenance of appropriate refrigeration systems maintained at the desired temperatures in order to bring the beverage to the desired temperature; after which the typical glycol circulating system above-referred to may be utilized at the time of dispensing of the beverage.

In many areas of the world there are no refrigeration systems available for cooling the beverages within the containers. In addition thereto there may be instances when the consumers of the beverages are in a remote area where there is no refrigeration available, but would still prefer to have the beverage chilled to the desired temperature before consuming the same.

Most beverage dispensing assemblies are not provided with a type of automatic adjustment of the pressure level within the container and the pressure level is typically manually adjusted. The pressure level is typically maintained by the utilization of a carbon dioxide system. If the pressure level within the container is not properly maintained, as the beverage is dispensed, it will become impossible to extract the beverage from the beverage container since such is accomplished through the utilization of the pressure head above the beverage in the beverage container.

Therefore, there is a need for a keg like beverage container which has the capability of automatically cooling the beverage contained therein without the necessity of external refrigeration and also which maintains a pressure head within the beverage container for automatically dispensing the beverage on a continuous basis as desired by the consumer.

SUMMARY OF THE INVENTION

A self cooling and self dispensing keg like beverage container having a beverage chamber including a sidewall and upper and lower walls enclosing the chamber, a heat exchange unit suspended within the beverage chamber to be surrounded by the beverage but not in contact with the walls, the heat exchange unit includes a metal housing within which there is disposed a plurality of discrete carbon sections each defining an opening there through, a metal tube received in each of the openings and sealed at the top and bottom of the metal housing, means for injecting a gas under pressure into the housing to be adsorbed by the carbon, means for releasing the gas under pressure for cooling the beverage contained within the chamber and means for dispensing the beverage from the chamber.

DETAILED DESCRIPTION

As above-indicated the keg like apparatus of the present invention is utilized for dispensing beverages of various types which the consumer prefers to have chilled prior to consumption. Although there are many such beverages in existence which may be utilized with the apparatus of the present invention, the following discussion, for purposes of ease of description and illustration will be given with respect to a reusable beer keg. Although beer kegs of various sizes maybe utilized, this description will be given particularly with respect to a beer keg that includes displacement for a heat exchange unit contained therein in the amount of 10 liters and a product capacity within the container of 20 liters. The beer within the container or keg will be self dispensed under carbon dioxide pressure and the dispensing pressure will typically be between 0.9 to 1.5 Bars. Through the utilization of such a structure and with a heat exchange unit suspended internally of the beverage container so that it is totally surrounded by the beverage it has been found beer can be cooled to a temperature of approximately 5° C. in a period of approximately 3 minutes. As the beer is withdrawn from the keg a dispense gas canister contained internally of the beverage containing portion of the keg will automatically release carbon dioxide to maintain the appropriate pressure head to allow dispensing the beer within the keg without the necessity of introduction of additional carbon dioxide or other gas from externally of the beverage container. It has been found that a beer keg constructed in accordance with the principles of the present invention will maintain the beer in the keg cooled for approximately six (6) hours.

Figure 1:
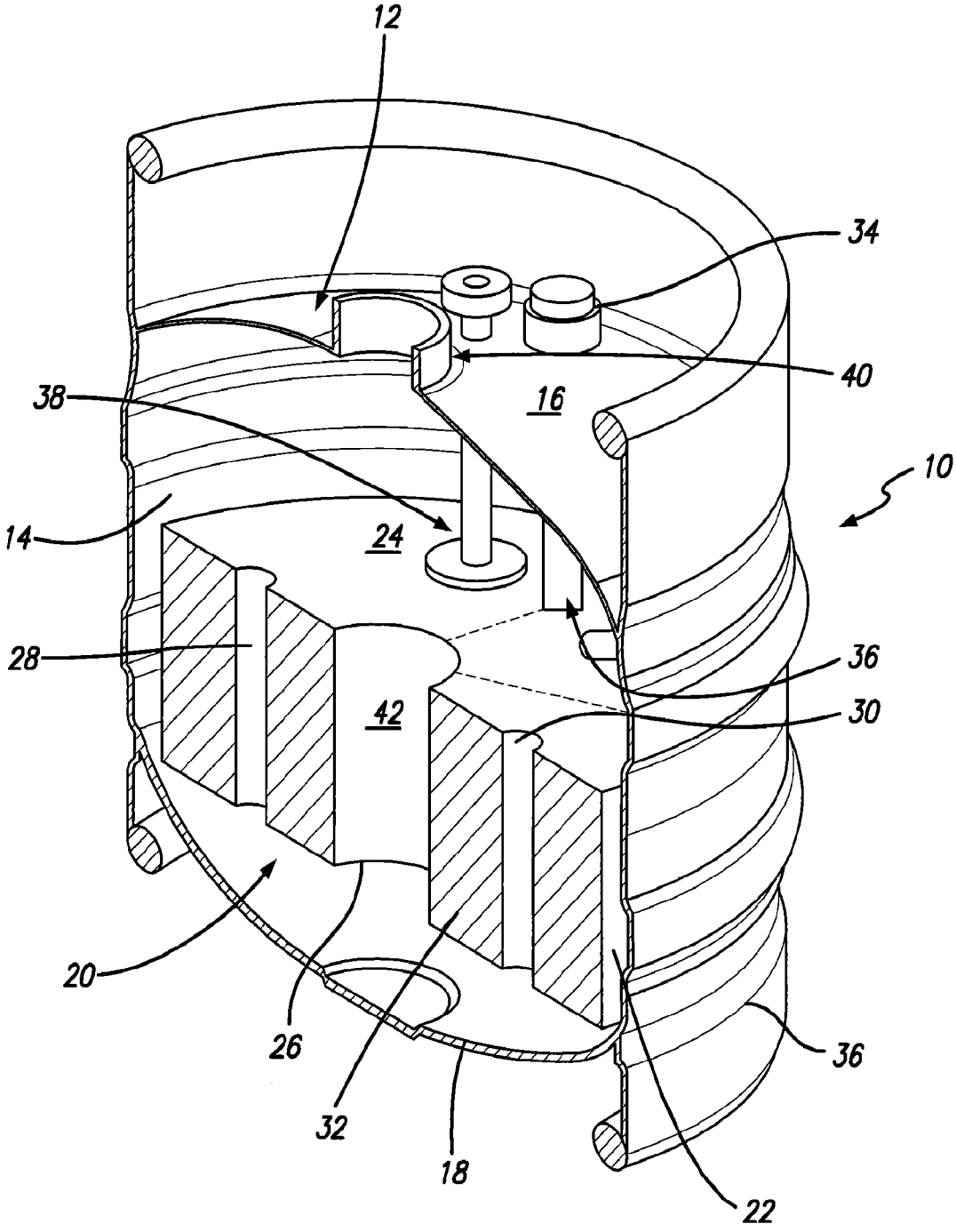
FIG. 1 is a cut-away perspective view illustrating the self cooling beverage container of the present invention.

Referring now more particularly to FIG. 1 there is illustrated a beer keg (10) which has the traditional cylindrical shape. Disposed internally of the keg (10) is a beverage containing chamber (12) having a cylindrical sidewall (14) and a top (16) and a bottom (18). A heat exchange unit (20) is suspended within the chamber (12) in a manner to be described more fully below. The heat exchange unit (20) is surrounded by the beer which is contained within the chamber (12). The heat exchange unit (20) includes a sealed housing (22) which has a top (24) and a bottom (26). A plurality of openings such as shown at (28) and (30) extend through the heat exchange unit (20) from the top (24) to the bottom (26) thereof. The openings contain cooling tubes which are sealed to the top (24) and bottom (26) of the housing. Disposed within the housing (22) is a carbon material (32) which is capable of adsorbing a gas such as carbon dioxide.

Appropriate cooling gas inlets such as shown at (34) are provided to inject carbon dioxide gas through feed tubes such as shown at (36). The feed tubes are disposed by being connected sealingly, such as by welding, to the top surface (24) of the REU housing (22) such that the carbon dioxide cooling gas is injected into the interior portion of the housing (22) under pressure so that the carbon material is saturated by adsorption of the gas by the carbon. The gas inlet (34) includes an adapter for receiving a valve and the feed tube is welded to the top (16) of the keg to suspend the heat exchange unit (20) within the chamber (12) but not in contact with the walls of the chamber. A dispense gas canister (38) is disposed within and becomes a part of the heat exchange unit (20) and is utilized to maintain the appropriate head pressure within the chamber (12) to provide for appropriate dispensing of the beer contained within the keg (10). The dispensing gas may also be positioned externally of the REU. The typical keg spear opening (40) is provided in the top (16) of the chamber (12) and is utilized to receive the standard beer dispensing tap well known to the industry. The well known standard keg spear and dispensing top fitting (not shown) will be positioned in the opening (40) and used to dispense the beer from the keg. The outlet of the dispense gas canister (38) is connected through the dispensing tap to inject the carbon dioxide gas into the chamber (12) to maintain the proper equilibrium to insure dispensing of the beer as desired.

When the chamber (12) is appropriately filled with beer by providing the same through the spear opening, the heat exchange unit (20) is surrounded by the beer. Upon activation of an appropriate valve the gas under pressure which has been adsorbed by the carbon is allowed to desorb from the carbon and escape to the atmosphere, and in doing so will transfer the heat from the beer surrounding the heat exchange unit (20) causing the beer to cool. The cooling activity of the beer will cause the beer to move through the openings such as (28) and (30), as well as the central opening (42) by way of convection thus exposing the beer within the container to a greater surface area of the exterior of the heat exchange unit thus providing additional and quicker cooling of the beer to bring it to a temperature which is desirable for consumption.

Figure 2:
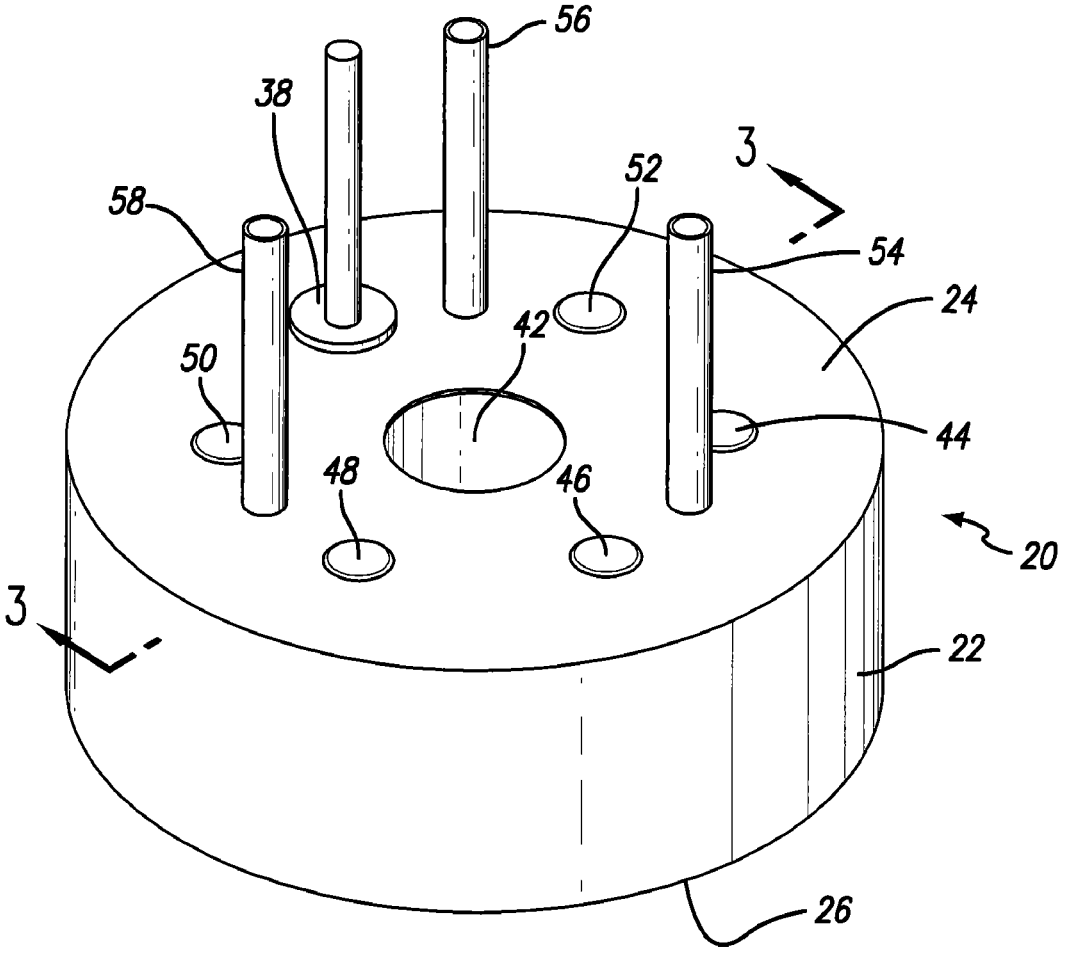
FIG. 2 is a perspective view of the heat exchange unit utilized in the container as shown in FIG. 1.

Referring now more particularly to FIG. 2 there is illustrated the heat exchange unit (20). The housing (22) is preferably constructed of metal such as 316 stainless steel. The various sections of the housing are welded together to form a sealed and gas tight construction. As is shown in FIG. 2 there are five cooling tube openings (44), (46), (48), (50) and (52) a central opening (42) is provided to receive a spear that goes down to the bottom of the keg for the purpose of drawing the beer off from the keg when it is desired to consume the same. Three gassing tubes (54), (56) and (58) are also welded to the top surface (24) of the housing (22) and are used to inject the carbon dioxide into contact with the carbon which is contained internally of the housing (22). The dispense gas canister (38) is contained also within the heat exchange unit (20) as will be described in further detail below.

Figure 3:
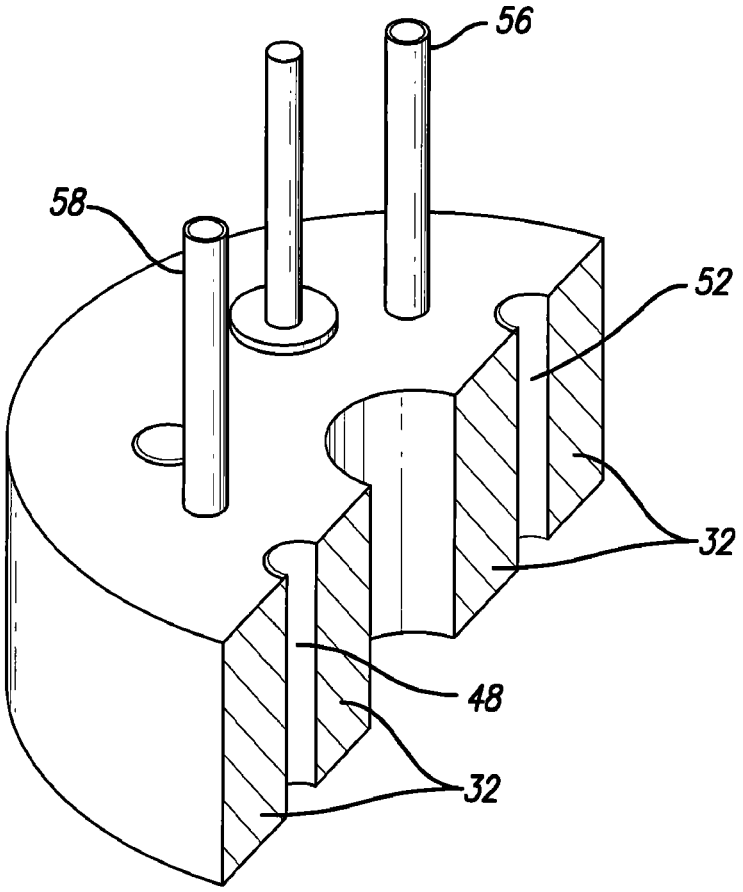
FIG. 3 is a cross-sectional view of the heat exchange unit of FIG. 2 taken about the lines 3-3 of FIG. 2.

Referring now more particularly to FIG. 3 there is illustrated a cross sectional perspective view of the heat exchange unit as shown in FIG. 2. The carbon material (32) can be seen as completely filling the interior of the heat exchange unit housing (22). The cooling tubes are also better illustrated as shown at (48) and 52). The cooling tubes (48) and (52) are also constructed from 316 stainless steel and are welded to the top surface (24) and the bottom surface (26) of the housing (20) to provide a completely gas tight housing. As is also shown, the gas feed tubes (56) and (58) are also welded to the top (24) of the REU housing and are disposed in such a manner that gas is provided through the feed tubes such as (56) and (58) onto the top surface of the carbon material (32) to allow the carbon dioxide gas to be adsorbed by the carbon (32) until the carbon is saturated.

Figure 4:
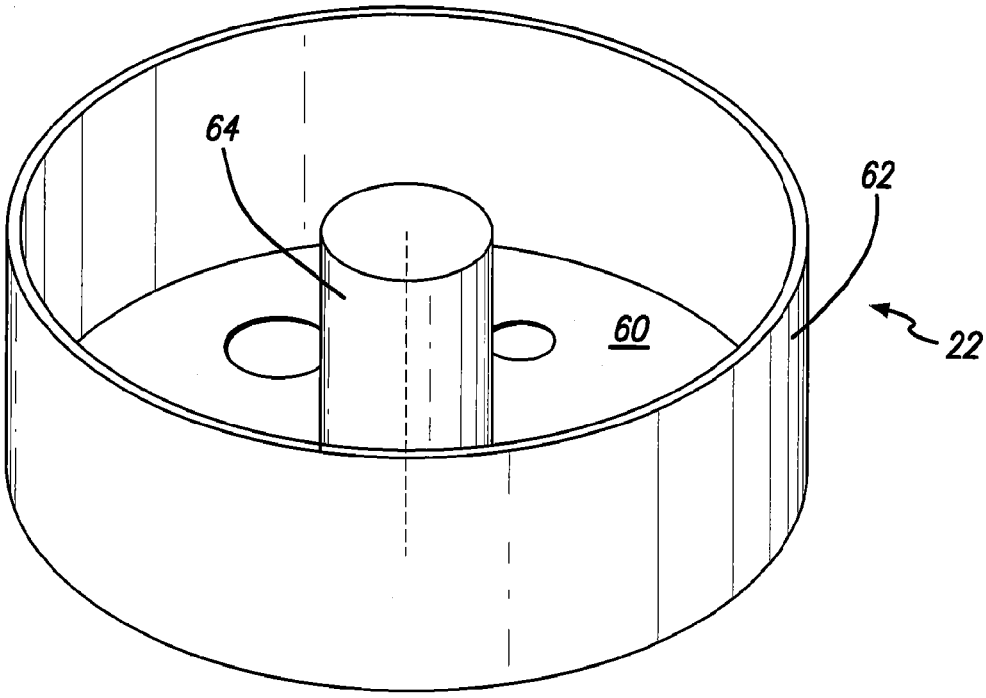
FIG. 4 is a perspective view of the heat exchange unit housing without the top cover.

As shown in FIG. 4, the REU housing (22) is constructed of a bottom (60) and a sidewall (62) with the riser (64) providing the opening (42). The bottom and sidewalls of the housing as shown in FIG. 4 may be formed by a deep draw process from a sheet of stainless steel material. The top (24) would then be roll welded in place after the insertion of the carbon material (32). Alternatively, the entire housing (22) for the REU (20) may be constructed of sections of 316 stainless steel all of which are welded together to provided the desired structure. In any event, the housing when completed provides a fluid or gas tight structure that contains the carbon material.

Figure 5:
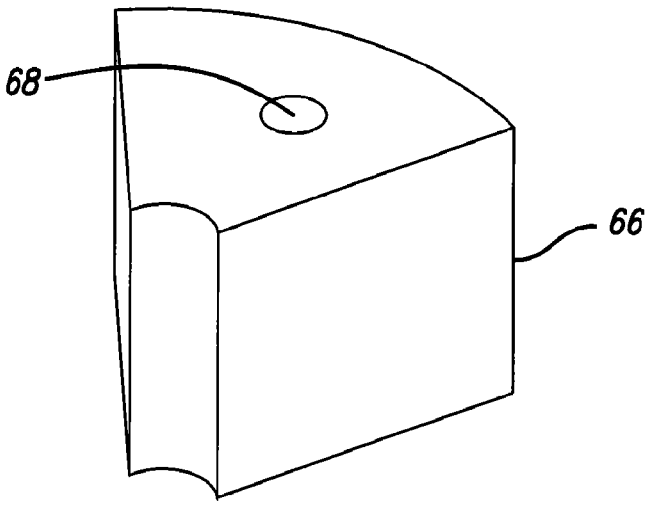
FIG. 5 is a perspective view of a section of carbon utilized as part of the heat exchange unit.

Referring now more particularly to FIG. 5 there is illustrated a section (66) of an appropriate carbon material which is utilized to adsorb the carbon dioxide material. A hole (68) is provided through the section (66) of the carbon material and is adapted to receive a cooling tube such as shown at 48 and 52 in FIG. 3. The preferred carbon material is an activated carbon and thermal enhancing material and may also include a binder in the composition. Such a material is described in U.S. Pat. No. 7,185,511 which is incorporated herein by reference. As is therein shown, the carbon material will adsorb gas such as carbon dioxide and when that gas is desorbed the temperature of the surrounding beverage can be reduced from room temperature to approximately 5° C. in approximately three minutes. The activated carbon is compressed so as to accommodate a greater amount of carbon particles within a predetermined volume to provide adsorption of a larger volume of carbon dioxide gas and thus providing a greater cooling of the beverage.

Figure 6:
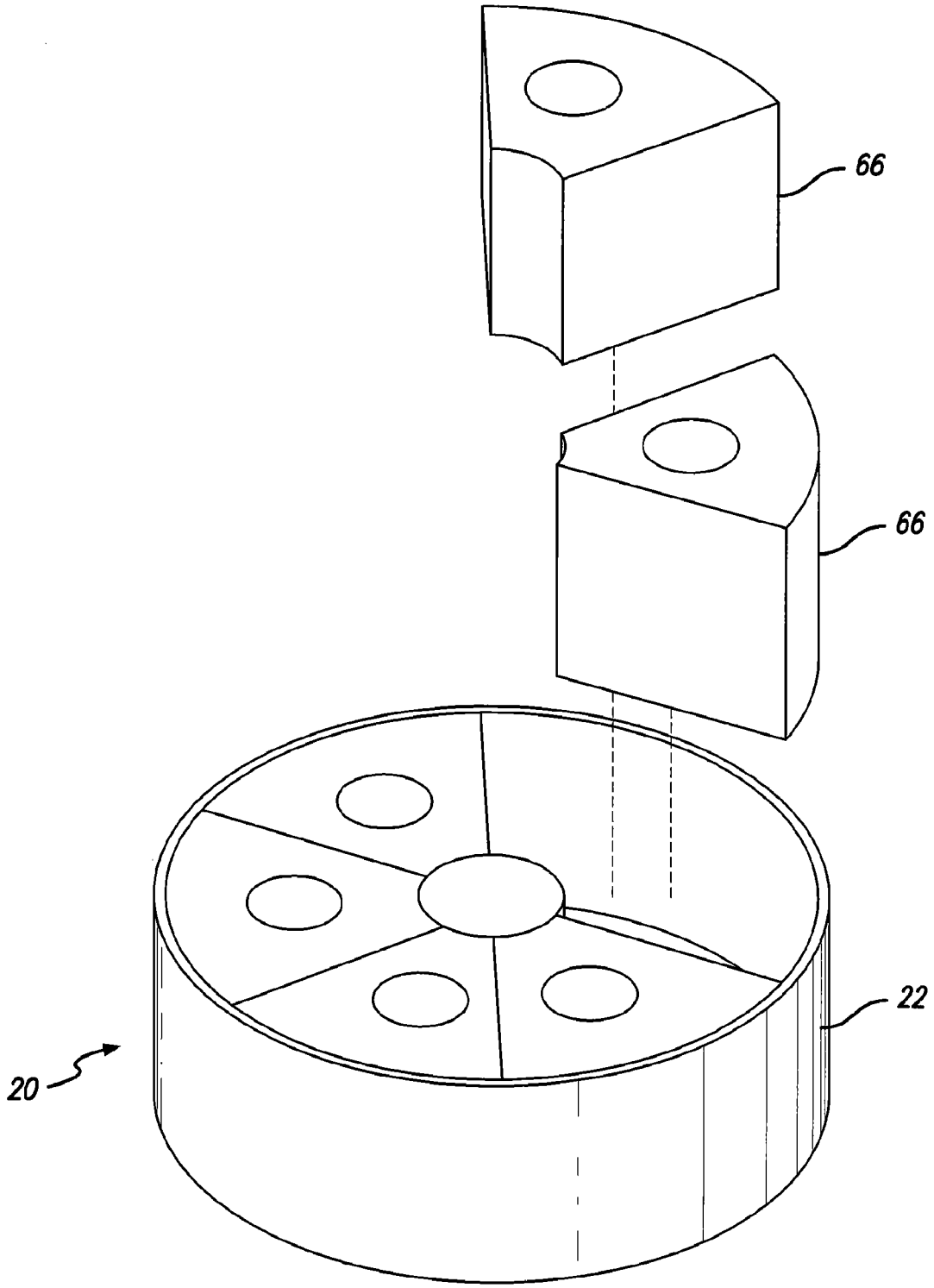
FIG. 6 illustrates the sections of carbon disposed within the REU housing as shown in FIG. 4.

Referring now more particularly to FIG. 6 there is an illustration of positioning the carbon sections (66) within the housing (22) of the heat exchange unit (20). As is illustrated in FIG. 6, the sections (66) of the carbon material are preferably formed in a pie shaped fashion. This particular geometrical configuration is utilized because it is simple and easy to manufacture and at the same time is relatively easy to install into the housing (22) of the REU (20). It should be understood that the carbon sections may have any configuration desired depending upon the construction of the housing. It should be noted that each of the carbon sections 66 define an opening there through for receiving a cooling tube as above described. It will also be noted that there are six (6) sections of compressed carbon material, but it should be understood that there may be any number of such sections as desired with each one defining an opening there through.

Figure 7:
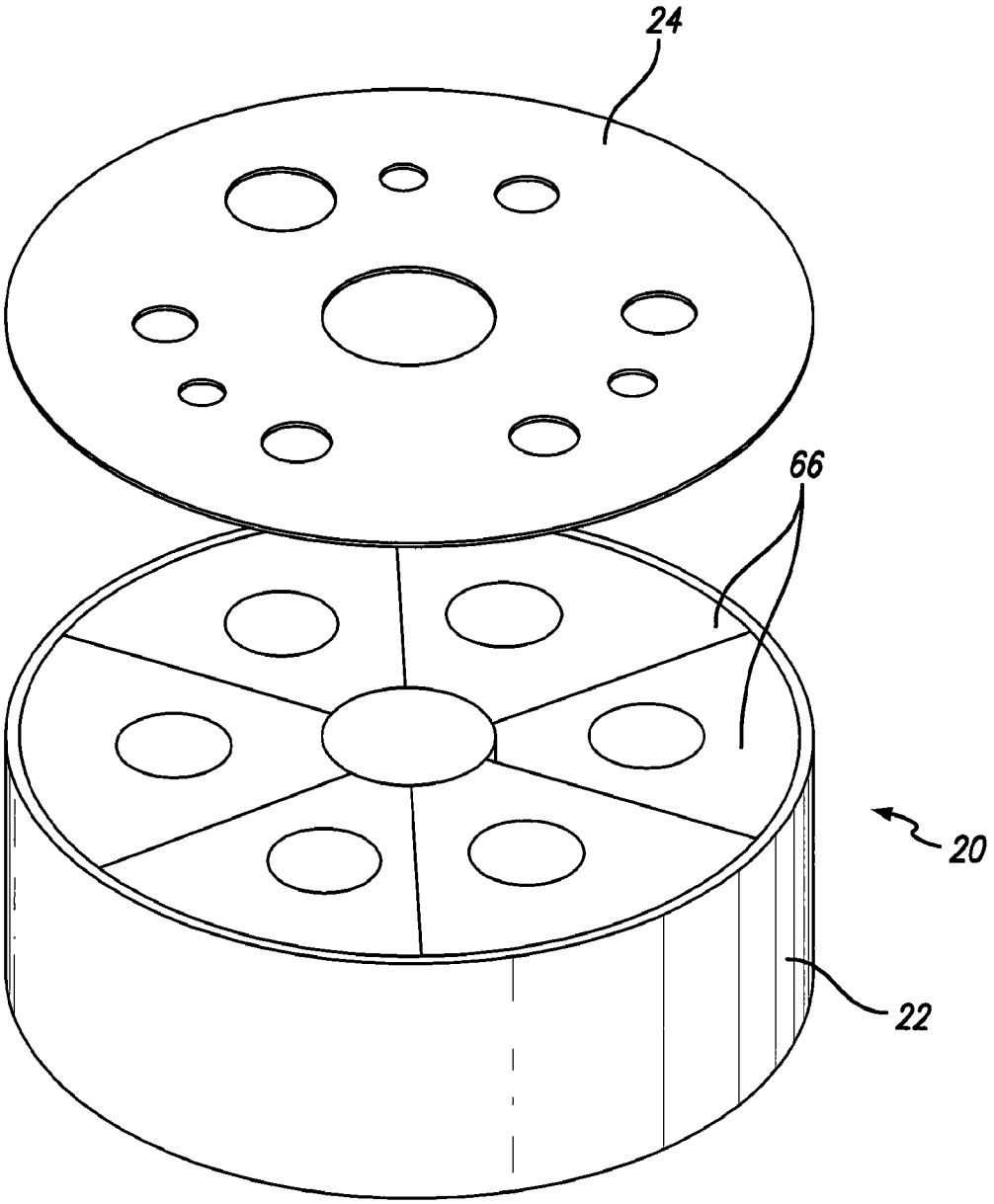
FIG. 7 illustrates the heat exchange unit housing with the carbon sections inserted therein and the placement of a top cover to be sealed to complete the housing for the heat exchange unit.

Referring now more particularly to FIG. 7 there is illustrated the REU (20) wherein the various sections (66) of the carbon material have been inserted into place and the top cover (24) is positioned to be placed over the top of the housing (22) and to be welded in place to complete the construction of the heat exchange unit (20).

Figure 8:
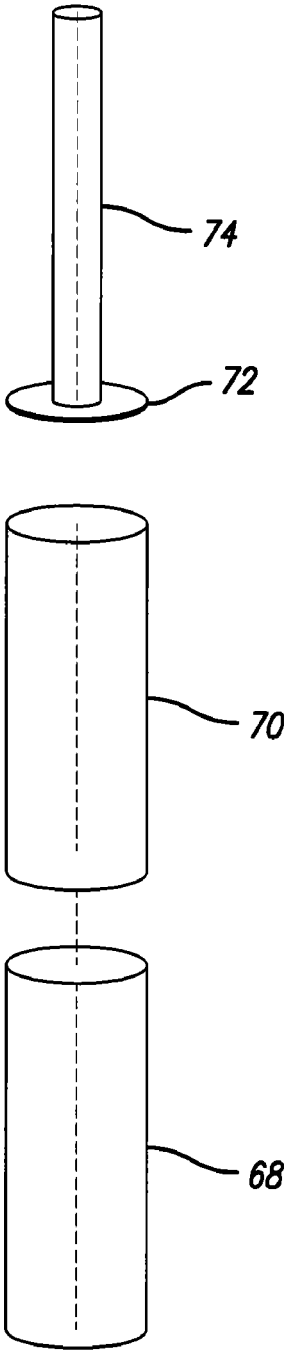
FIG. 8 is an exploded view of a dispense gas canister which is included as a part of the completed container as illustrated in FIG. 1.

Referring now more particularly to FIG. 8 the gas canister for maintaining of the pressure within the keg in proper equilibrium for accomplishing dispensing of the beer is illustrated. As is shown, there is a chamber body (68) which receives a carbon slug (70) formed of a similar material to that as the section (66) above referred to. A sealing lid and feed tube as shown at (72) and (74), respectively is then welded to the top of the chamber body (68) to provide a gas tight chamber and the entire construction is inserted into the heat exchange unit (20) as shown in FIGS. 2 and 3. As above indicated, the carbon material (70) in the canister is charged with carbon dioxide in a manner above-described such that it becomes saturated. As the beverage is withdrawn through the tap the adsorbed gas within the canister is released through the tap by way of a regulator valve to maintain equilibrium within the chamber so that the beer in the container can continue to be dispensed without additional effort.

It should be recognized that with respect to the REU, the gas feed tubes (54) are disposed such that they are preferably at the separation points of the sections (66) of the carbon material. This allows the carbon dioxide gas to more easily find its way between the carbon sections to enhance the adsorption of the $C0_2$ gas in the REU.

Figure 9:
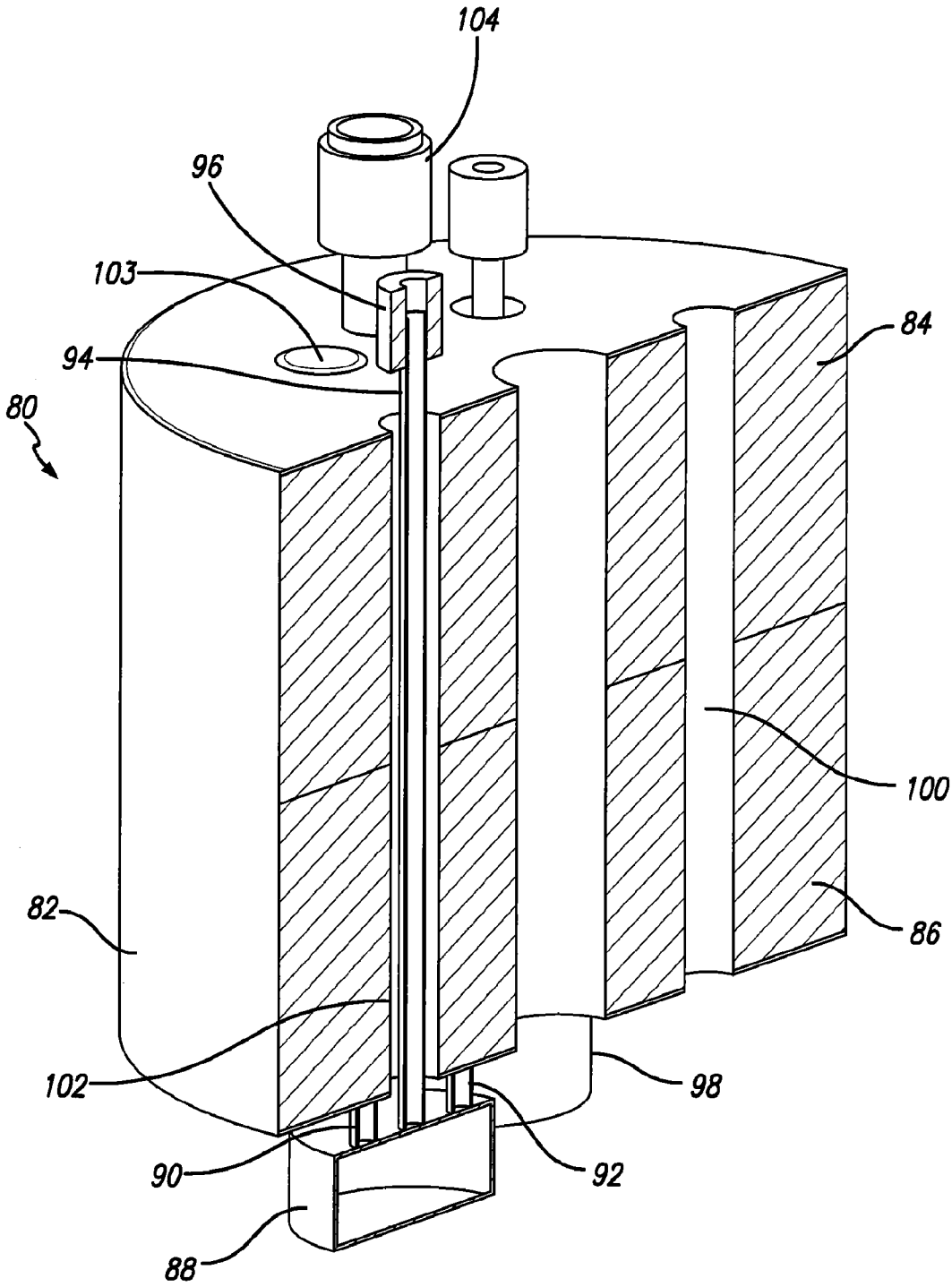
FIG. 9 is a perspective cutaway view illustrating an alternative embodiment of the REU and dispense gas canister.

Referring now more particularly to FIG. 9, there is therein disclosed an alternative embodiment of the REU and the dispense gas canister. The REU 80 includes a housing 82 constructed preferably of stainless steel within which is disposed segments of compacted carbon. As is illustrated, there is provided two layers of carbon segments 84 and 86. These layers are preferably constructed of smaller pie shaped segments as above described. By utilizing the segments formed in two layers an increased aspect ratio of the REU is provided. This allows the entire contents of the keg to be cooled at one time. This in turn results in a very cold dispense of the beverage the very first time.

As is also illustrated, the dispense gas canister 88 is disposed below the REU housing 82 and is supported for example by rods 90 and 92 which are welded to the canister 88 and the bottom of the housing 82. A tube 94 having an appropriate valve 96 affixed thereto communicates with the interior of the canister 88 and the interior of the keg 10. As above described, carbon dioxide is injected through the tube 94 into the canister 88 and is adsorbed by compacted carbon therein and then desorbed as the beer is drawn from the keg to maintain the appropriate head pressure to assure that the beer can be drawn from the keg. It has been found that a plurality of canisters may be used as illustrated at 98 to maintain the proper head pressure.

As shown in FIG. 9, the REU 80 includes cooling tubes 100, 102 and 103 and appropriate gas inlet valves 104 and attached tubes for injecting the carbon dioxide gas for adsorption by the compacted carbon 84 and 86 and desorption there from for cooling the beer or other liquid contained within the keg 10.

There has thus been disclosed a self cooling and self dispensing beverage keg, particularly one which can self cool and self dispense beer as well as other beverages without the necessity of external refrigeration and will provide approximately six (6) hours of maintained cooling.

What is claimed is:

1. A self cooling and self dispensing beverage keg comprising:

(A) a beverage chamber including a plurality of walls including a sidewall and upper and lower walls enclosing said chamber;

(B) a heat exchange unit coupled to said upper wall and suspended within said beverage chamber but not in contact with said plurality of walls;

(C) said heat exchange unit comprising:

(1) a metal housing having a top and a bottom;

(2) a plurality of discrete carbon sections each defining an opening therethrough disposed within said housing;

(3) a metal tube received within each of said openings in said carbon sections and sealed to said top and bottom of said housing;

(D) means for injecting carbon dioxide gas under pressure into said housing, said carbon dioxide gas being adsorbed by said carbon;

(E) means for releasing said carbon dioxide gas under pressure from said housing, which cools beverage contained within said chamber; and (F) means for dispensing beverage from said chamber.

2. The self cooling and self dispensing beverage keg as defined in claim 1 wherein said metal housing of said heat exchange unit and said metal tubes are affixed to the top and bottom of said housing.

3. The self cooling and self dispensing beverage keg as defined in claim 2 wherein said metal housing and said metal tubes are constructed of stainless steel.

4. The self cooling and self dispensing beverage keg as defined in claim 2 wherein said means for injecting a gas under pressure includes a plurality of metal gassing tubes having first and second ends with said first end being affixed to said top of said heat exchange unit housing and a valve affixed to said second end thereof.

5. The self cooling and self dispensing beverage keg described in claim 4 wherein said metal housing, said metal tubes and said metal gassing tubes are constructed of stainless steel.

6. The self cooling and self dispensing beverage keg as defined in claim 4 wherein said first end of each of said gassing tubes is positioned to be at an intersection of two discrete carbon sections.

7. The self cooling and self dispensing beverage keg as defined in claim 4 which further includes an adaptor secured to said second end of each said gassing tube, each said gassing tube being welded to said upper wall of said beverage chamber to suspend said heat exchange unit within said chamber and said adaptor being welded to said second end of said gassing tube.

8. The self cooling and self dispending beverage keg as defined in claim 1 which further includes a separate canister containing a carbon slug for adsorbing carbon dioxide gas under pressure, a regulator valve affixed to said canister for releasing carbon dioxide gas into said chamber to maintain a pressure within said chamber sufficient to dispense the beverage from said chamber.

9. The self cooling and self dispensing beverage keg as defined in claim 8 which includes a plurality of separate canisters.

10. The self cooling and self dispensing beverage keg as defined in claim 9 wherein said plurality of canisters are disposed within said keg but outside said heat exchange unit.

11. The self cooling and self dispensing beverage keg as defined in claim 10 wherein said plurality of canisters are suspended beneath said heat exchange unit and are surrounded by the beverage in said keg.

* * * * *